US011607777B2

(12) United States Patent
Koechl et al.

(10) Patent No.: US 11,607,777 B2
(45) Date of Patent: Mar. 21, 2023

(54) GRINDING WHEEL WITH A VIBRATION-DAMPING SUPPORT BODY

(71) Applicant: Tyrolit—Schleifmittelwerke Swarovski K.G., Schwaz (AT)

(72) Inventors: Harald Koechl, Schwaz (AT); Karl Mayrhofer, Gnadenwald (AT)

(73) Assignee: TYROLIT—SCHLEIFMITTELWERKE SWAROVSKI K.G., Schwaz (AT)

( * ) Notice: Subject to any disclaimer, the term of this patent is extended or adjusted under 35 U.S.C. 154(b) by 841 days.

(21) Appl. No.: 16/173,034

(22) Filed: Oct. 29, 2018

(65) Prior Publication Data

US 2019/0061108 A1 Feb. 28, 2019

Related U.S. Application Data

(63) Continuation of application No. PCT/AT2017/060099, filed on Apr. 19, 2017.

(30) Foreign Application Priority Data

May 13, 2016 (AT) ..... A 50447/2016

(51) Int. Cl.
*B24D 5/16* (2006.01)
*B24D 5/12* (2006.01)
(Continued)

(52) U.S. Cl.
CPC ..... *B24D 5/16* (2013.01); *B24B 41/007* (2013.01); *B24D 5/02* (2013.01); *B24D 5/12* (2013.01)

(58) Field of Classification Search
CPC ... B24D 5/16; B24D 5/02; B24D 5/12; B24D 7/10; B24B 45/00; B24B 41/007; B24B 55/00; F16F 7/00
See application file for complete search history.

(56) References Cited

U.S. PATENT DOCUMENTS 3,555,744 A * 1/1971 Coes, Jr. ..... B24B 45/00 451/28
3,613,472 A * 10/1971 Held ..... B23F 21/03 74/391
(Continued)

FOREIGN PATENT DOCUMENTS

CH 575 276 5/1976
CN 101003125 7/2007
(Continued)

OTHER PUBLICATIONS

"Correlation of the Damping Capacity of Cast Iron with Its Mechanical Properties and Microstructure" by M.A.O Fox and R.D. Adams, Journal of Mechanical Engineering Science 1973, vol. 15 No. 2 (Year: 1973).*
(Continued)

*Primary Examiner* — Joel D Crandall
*Assistant Examiner* — Makena S Markman
(74) *Attorney, Agent, or Firm* — Wenderoth, Lind & Ponack, L.L.P.

(57) ABSTRACT

A grinding wheel includes a support body which has a circumferential surface and a central coupling region for attaching the grinding wheel to a rotary drive for rotating the grinding wheel about a rotational axis running through the central coupling region. The grinding wheel also includes a grinding layer which is applied onto the circumferential surface of the support body. The support body includes a first part and a second part connected to the first part. The first part has the circumferential surface, and the second part has the coupling region and consists essentially of a vibration-damping material.

21 Claims, 2 Drawing Sheets

(51) Int. Cl.
*B24B 41/00* (2006.01)
*B24D 5/02* (2006.01)

(56) References Cited

U.S. PATENT DOCUMENTS

| | | | | |
|---|---|---|---|---|
| 4,541,205 | A * | 9/1985 | Patrello | B24D 5/16 451/342 |
| 5,584,753 | A * | 12/1996 | Takahashi | B23C 5/26 451/342 |
| 6,454,639 | B1 * | 9/2002 | Huber | B24B 45/00 451/342 |
| 7,510,464 | B2 * | 3/2009 | Stierle | B24B 23/028 451/343 |
| 7,588,484 | B2 | 9/2009 | Momosaki | |
| 7,621,801 | B2 * | 11/2009 | Himmelsbach | B24B 45/00 451/342 |
| 8,231,438 | B2 | 7/2012 | Kuhnle et al. | |
| 9,085,058 | B2 * | 7/2015 | Clabunde | B23Q 11/0032 |
| 2007/0010179 | A1 * | 1/2007 | Lamprecht | B24D 5/165 451/343 |
| 2007/0037501 | A1 * | 2/2007 | Buljan | B24D 3/06 451/548 |
| 2007/0167119 | A1 | 7/2007 | Momosaki | |
| 2008/0287049 | A1 * | 11/2008 | Salzgeber | B24D 5/16 451/548 |
| 2009/0068936 | A1 * | 3/2009 | Kuhnle | B24B 41/007 451/344 |
| 2011/0017043 | A1 * | 1/2011 | Angelo | B23D 61/026 83/676 |
| 2012/0298089 | A1 | 11/2012 | Sumida et al. | |
| 2019/0030683 | A1 * | 1/2019 | Rifaut | B24D 5/16 |

FOREIGN PATENT DOCUMENTS

| | | |
|---|---|---|
| CN | 101076431 | 11/2007 |
| CN | 101484280 | 7/2009 |
| EP | 2 527 090 | 11/2012 |
| JP | 56-20756 | 2/1981 |
| JP | 59-214561 | 12/1984 |
| JP | 62-68282 | 3/1987 |
| JP | 3-26467 | 2/1991 |
| JP | 2002-59367 | 2/2002 |
| JP | 2005-125412 | 5/2005 |
| JP | 2009-515715 | 4/2009 |
| JP | 2010-42498 | 2/2010 |
| JP | 3178096 | 8/2012 |
| JP | 2012-245607 | 12/2012 |
| WO | 2007/057287 | 5/2007 |

OTHER PUBLICATIONS

International Search Report dated Jun. 30, 2017 in International (PCT) Application No. PCT/AT2017/060099.

D3—The Japan Institute of Metals and Materials; Revised 5th Edition of Handbook of Metals, Maruzen Co., Ltd., Oct. 5, 1996, p. 593, with English Abstract (Japanese Examiner' Comment).

D4—The Iron and Steel Institute of Japan, ed.; The Third Edition of Steel Handbook, vol. V Casting, Forging and Powder Metallurgy, Maruzen Co., Ltd, Oct. 1, 1982, pp. 118-123, with English Abstract (Japanese Examiner' Comment).

D5—New Mechanical Engineering Handbook Editorial Committee, ed.; New Mechanical Engineering Handbook, Revised Edition, Rigogakusha Publishing Co., Ltd., Dec. 25, 1998, vol. 1, pp. 4-6 and 4-7, with English Abstract (Japanese Examiner' Comment).

D6—Saburo Nagakura, Yoshio Iguchi, Hiroshi Ezawa, Shu Iwamura, Fumitaka Sato, Ryogo Kubo, ed; The 5th Edition of Iwanami Encyclopaedia of Physics and Chemistry, Iwami Shoten, Apr. 24, 1998, p. 851, with English Abstract (Japanese Examiner' Comment).

D7—Kikakurui.com, G5501-1995 Grey iron castings, found Dec. 23, 2020 at https://kikakurui.com/g5/G5501-1995-01.html, with English Abstract (Japanese Examiner' Comment).

D8—Kikakurui.com, G5502-2001 Spheroidal graphite iron castings, found Dec. 23, 2020 at https://kikakurui.com/g5/G5502-2007-01html, with English Abstract (Japanese Examiner' Comment).

D9—Kikakurui.com, G5505-2013CV Compacted (vermicular) graphite cast irons, found Dec. 23, 2020 at http://kikakurui.com/g5/G5505-2013-01.html, with English Abstract (Japanese Examiner' Comment).

* cited by examiner

GRINDING WHEEL WITH A VIBRATION-DAMPING SUPPORT BODY

BACKGROUND OF THE INVENTION

1. Field of the Invention

The invention relates to a grinding wheel with a support body, which has a central coupling region for attaching the grinding wheel to a rotary drive for rotating the grinding wheel about a rotational axis running through the coupling region and a circumferential surface, and with a grinding layer which is applied, in particular sintered, onto the circumferential surface of the support body.

2. Description of the Related Art

FIG. 1 shows a grinding wheel 101 according to the state of the art. The grinding wheel 101 comprises a support body 102 made of steel with a central coupling region 104 for attaching the grinding wheel 101 to a rotary drive for rotating the grinding wheel 101 about a rotational axis 105 running through the coupling region 104. The support body 102 also has a circumferential surface 106, to which a grinding layer 107 is applied. In the grinding operation, such a grinding wheel 101 can cause deafening noise, whereby the use of ear protection is necessary. The reason for this is that, during the grinding operation, vibrations occur, which radiate out over all the regions of the grinding wheel and of the workpiece to be machined. If one or more resonant frequencies are excited, an increase in the vibrations can even occur. The accuracy and therefore the quality of the grinding result can also be negatively affected by the vibrations.

SUMMARY OF THE INVENTION

The objective technical problem of the present invention thus consists of specifying a grinding wheel in which these disadvantages are avoided.

This problem is solved by the present invention.

According to the invention it is thus provided that the support body comprises a first part and a second part connected thereto, wherein the first part has the circumferential surface, and the second part has the coupling region and consists substantially of a vibration-damping material.

Due to the provision of a second part which consists substantially of a vibration-damping material, the vibrations occurring during the grinding operation can be efficiently absorbed in the support body. A resonance behavior in the range of the resonant frequencies is thereby suppressed. Even in the case of a high speed of rotation of the grinding wheel, no additional ear protection is needed. A vibration decoupling of the grinding wheel from the rotary drive also takes place, with the result that vibrations are not transmitted from the grinding wheel to the rotary drive—and vice versa. The vibration decoupling or damping through the second part of the support body thus takes place in two directions: firstly the vibrations generated by the grinding layer and secondly the vibrations caused by the rotary drive or the grinding machine are damped and decoupled from one another. In the state of the art a partial superimposition of and additional increase in these vibrations takes place. In addition, a damping of the vibrations caused by the spindle of the drive through the second part of the support body also has a further favorable effect, e.g. on the bearings of the spindle as the latter are subjected to less stress.

Furthermore, through the provision of a first part, it is possible to make this of a material which is heat-conducting and thus efficiently removes the heat forming in the region of the grinding layer. If only a one-part support body were to be used, which completely consists of a vibration-damping material, a heat accumulation would result, promoting vibrations and disc distortion. The invention thus not only consists of providing a support body with a vibration-damping material, but making the support body of at least two parts, wherein one part consists substantially of a vibration-damping material and the other part can be made from a material different therefrom, which has different physical properties favorable for the grinding operation.

If the grinding layer arranged on the first part is worn, the first part can be removed again and replaced with a fresh first part, wherein the second part can be reused. This is also a further advantage of the two-part structure of the support body in comparison with the state of the art.

The vibration-damping material of the second part can be, for example, cast iron, preferably with lamellar graphite (e.g. GJL 250), spheroidal graphite, vermicular graphite, or cast steel, and/or aluminum bronze and/or fiber-reinforced, preferably carbon fiber-reinforced, plastic.

The first part of the support body can substantially consist of a vibration-conducting and/or heat-conducting material, preferably steel or aluminum.

It is also possible for the grinding layer to be formed contact-less with respect to the second part, with the result that vibrations occurring during a grinding process can be indirectly transmitted via the first part to the second part and can be damped by means of the second part.

A particularly advantageous choice of material consists of the first part consisting substantially of a fiber-reinforced, preferably carbon fiber-reinforced, plastic and the second part consisting substantially of cast iron. In this case both parts are manufactured from a vibration-damping material. The invention thus does not necessarily provide that the first part consists of a vibration-conducting material.

In order to connect the first and second parts of the support body a, preferably axial, screw connection can be provided. It is particularly advantageous to provide, in the first and/or second part, recesses into which threaded bushes are inserted, preferably adhesively bonded. In this way the second part can be supplied for reuse in a particularly simple manner. Alternatively, it would however also be possible to cut the threads directly into the first and/or second part.

It has proved particularly advantageous that the second part has a volume approximately twice as large as the first part, and/or the second part has a greater weight in comparison with the first part. It is thus a very solid second part which, in a particularly efficient manner, damps the vibrations occurring in the grinding operation.

BRIEF DESCRIPTION OF THE DRAWINGS

Further details and advantages of the invention are explained in the following in more detail, by means of the description of the figures with reference to the drawings. There are shown in.

DETAILED DESCRIPTION OF THE INVENTION

Figure 1:
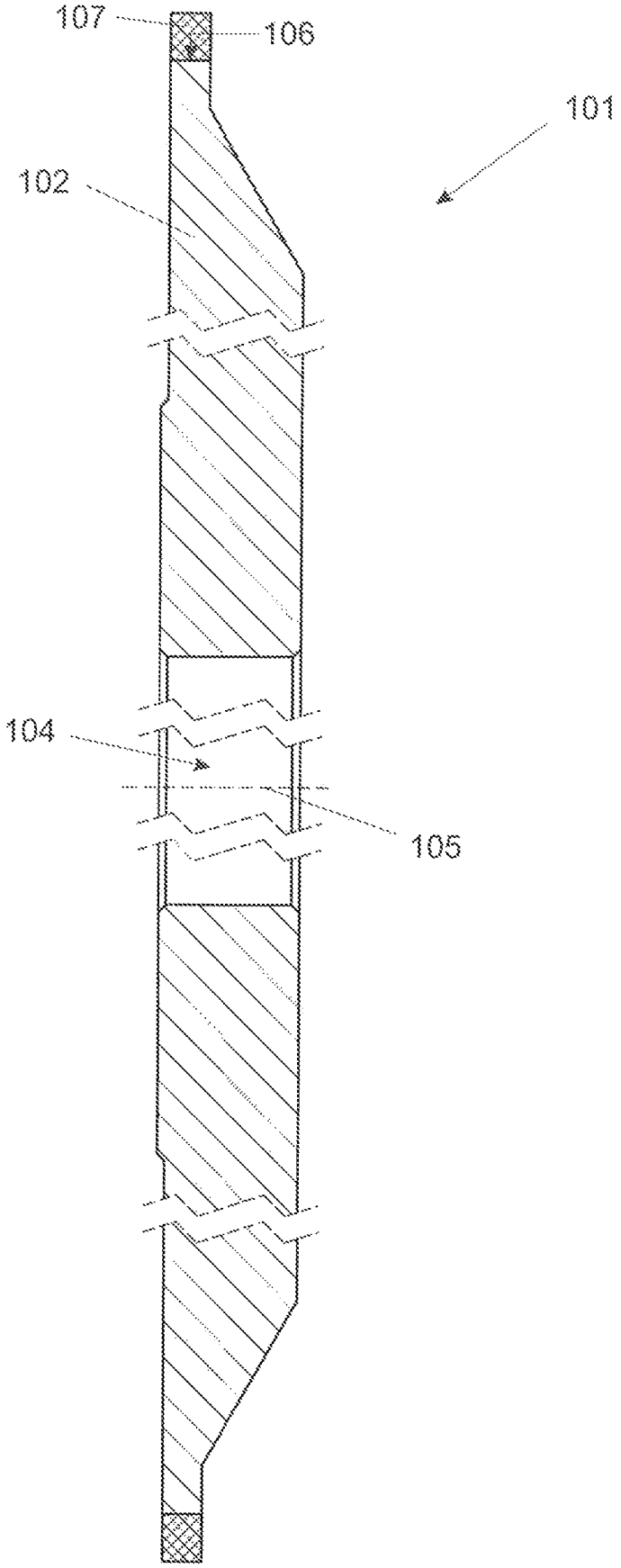
FIG. 1 a grinding wheel according to the state of the art, as already described at the outset, in a cross-sectional representation, FIG. 2 a preferred embodiment example of a grinding wheel according to the invention in cross section, FIG. 3 the first part of the support body of the grinding wheel from FIG. 2, and FIG. 4 the second part of the support body of the grinding wheel from FIG. 2.
Figure 2:
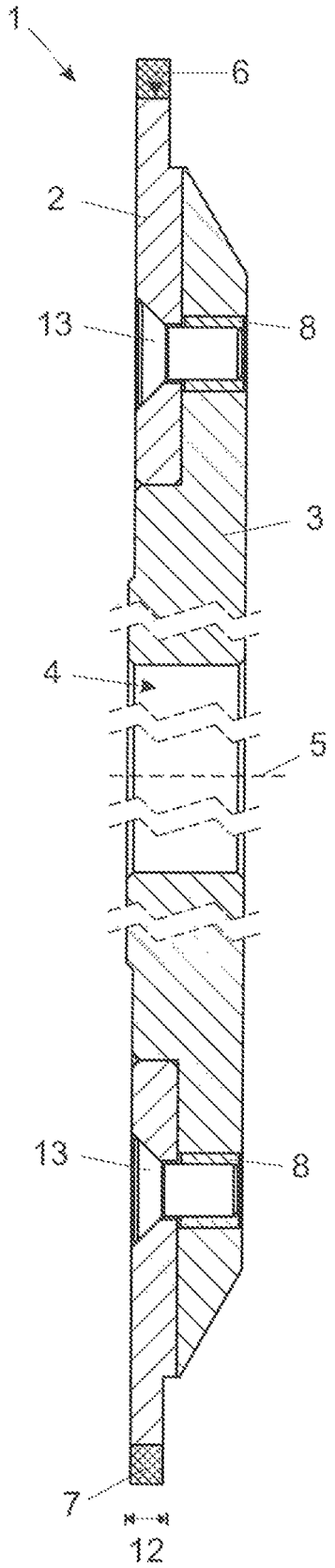
Figure 3:
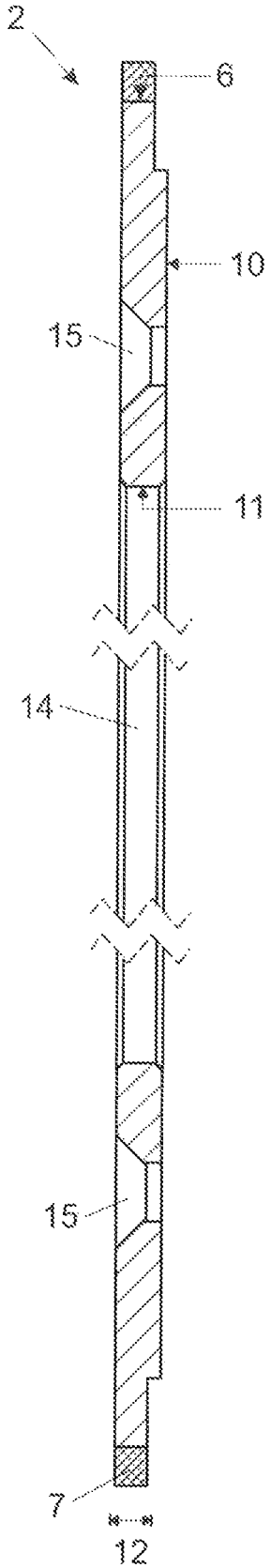
Figure 4:
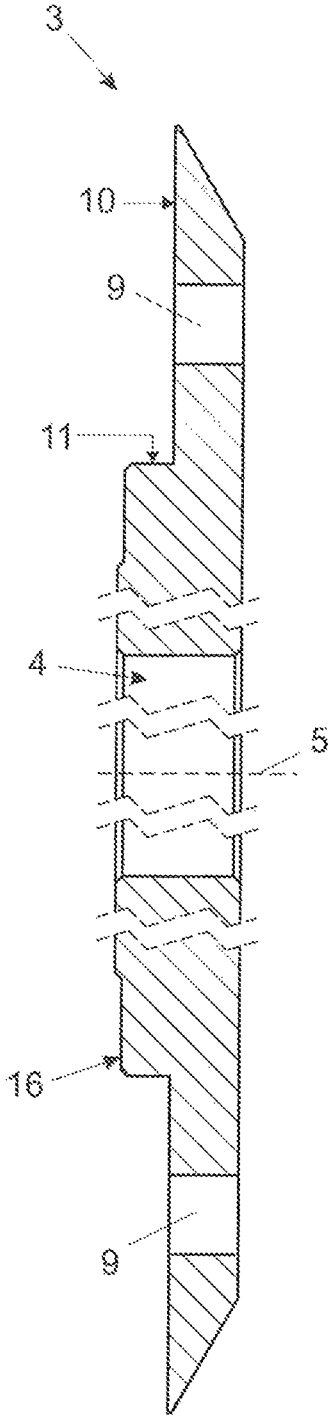

The grinding wheel 1 represented in FIGS. 2 to 4 comprises a support body which is constructed from a first part 2 and a second part 3 connected thereto. The first part 2 consists substantially of steel and is thus vibration- and heat-conducting. The first part 2 has a circumferential surface 6, onto which a grinding layer 7 with a width 12 of approximately 5 mm is sintered. Vibrations and heat occurring in the grinding operation can be dissipated via the first part 1.

The first part 2 is connected to the second part 3 via two contact surfaces 10 and 11, wherein the rotational axis 5 is oriented substantially normal to the contact surface 10 and substantially parallel to the contact surface 11. The contact surface 10 is many times larger than the contact surface 11. The vibrations are transmitted via these contact surfaces 10 and 11 to the second part 3. The latter consists substantially of a vibration-damping material, for example cast iron with lamellar graphite or aluminum bronze or fiber-reinforced, preferably carbon fiber-reinforced, plastic. Due to the vibration-damping properties of the second part 3 the vibrations transmitted by the first part 2 are damped.

Viewed as a whole, the grinding wheel 1 is formed asymmetrically with respect to an imaginary central plane normal to the rotational axis 5.

The second part 3 has a coupling region 4 for attaching the grinding wheel 1 to a rotary drive for rotating the grinding wheel 1 about a rotational axis 5 running through the coupling region 4. The coupling region 4 is formed as a central bore. The coupling region 4 is thus formed directly in the vibration-damping material of the second part 3, with the result that the second part 3 functions as a hub.

During the assembly of the grinding wheel 1 the second part 3, with an approximately cylindrical projection 16, is inserted into a corresponding recess 14, which is provided in the first part 2 until the parts 2 and 3 are flush with each other. The two parts 2 and 3 are then firmly connected to each other. In the embodiment example shown, there is an axial screw connection, i.e. a screw connection parallel to the rotational axis 5. For the realization thereof, in the second part 3 recesses 9 are arranged into which threaded bushes 8 are adhesively bonded. These are arranged flush with recesses 15, which are provided in the first part 2. In the recesses 15 there is room for a screw head. After the two parts 2 and 3 are joined together, these can be firmly connected to each other by screws 13.

If the grinding layer 7 arranged on the first part 2 is worn, the first part 2 can be removed again and replaced with a new first part 2, wherein the second part 3 can be reused. This is also a further advantage of the two-part structure of the support body 2 and 3 in comparison with the state of the art.

The arrangement of the recesses 9 and 15 in the two parts 2 and 3 represents only a possible example of how a screw connection can be realized. A reversed arrangement is also possible. Furthermore, as already stated, the thread can also be directly cut into one of the two parts 2 or 3. And finally, instead of the screw connection, other kinds of connection can also be used—alternatively or complementarily—such as for example a bonding of the two parts 2 and 3.

The invention claimed is:

1. A grinding wheel, comprising:

a support body; and a grinding layer, wherein:

the support body has an outer circumferential surface and a central coupling region for attaching the grinding wheel to a rotary drive for rotating the grinding wheel about a rotational axis running through the central coupling region;

the support body includes a first part and a second part connected together;

the first part and the second part are in direct contact with each other;

an inner diameter of the grinding layer is greater than an outer diameter of the support body and the grinding layer extends around the outer circumferential surface of the support body on only the first part;

the first part consists of a vibration-conducting material, and the first part is at least partially arranged between the grinding layer and the second part in a radial direction of the grinding wheel;

the second part exclusively has the central coupling region; and the second part consists of a vibration-damping material selected from the group consisting of cast iron, aluminum bronze, and combinations thereof.

2. The grinding wheel according to claim 1, wherein the vibration-damping material is cast iron including at least one of lamellar graphite, spheroidal graphite, vermicular graphite, or cast steel.

3. The grinding wheel according to claim 1, wherein the vibration-conducting material is steel or aluminum.

4. The grinding wheel according to claim 1, wherein:

the vibration-conducting material is fiber-reinforced plastic; and the vibration-damping material is cast iron.

5. The grinding wheel according to claim 4, wherein the fiber-reinforced plastic is carbon fiber-reinforced plastic.

6. The grinding wheel according to claim 1, wherein the grinding layer is not in direct contact with the second part such that vibrations occurring during a grinding process can be indirectly transmitted via the first part to the second part and the vibrations can be damped by the second part.

7. The grinding wheel according to claim 1, wherein the first part and the second part are connected to each other via a screw connection.

8. The grinding wheel according to claim 7, wherein the screw connection is an axial screw connection.

9. The grinding wheel according to claim 7, wherein:

recesses are defined in at least one of the first part or the second part; and threaded bushes are inserted into the recesses, respectively.

10. The grinding wheel according to claim 1, wherein:

a volume of the second part is twice as large as a volume of the first part; or a weight of the second part is greater than a weight of the first part.

11. The grinding wheel according to claim 1, wherein:

the first part and the second part are in direct contact with each other via a contact surface; and the contact surface is oriented so as to be: (i) normal to the rotational axis; or (ii) parallel to the rotational axis.

12. The grinding wheel according to claim 11, wherein the contact surface is planar.

13. The grinding wheel according to claim 1, wherein the first part is annular.

14. The grinding wheel according to claim 1, wherein the grinding wheel is asymmetrical with respect to a central plane normal to the rotational axis.

15. The grinding wheel according to claim 1, wherein the grinding layer has a cutting contact width of 5 mm.

16. The grinding wheel according to claim 1, wherein the central coupling region is defined in the vibration-damping material of the second part such that the second part functions as a hub.

17. The grinding wheel according to claim 1, wherein the central coupling region is a central bore.

18. The grinding wheel according to claim 1, wherein the grinding layer includes at least one of: (i) a superabrasive; (ii) a bond made of metal, plastic or ceramic; or (iii) an electroplated bond.

19. The grinding wheel according to claim 1, wherein the grinding layer is sintered onto the outer circumferential surface of the support body.

20. A grinding wheel, comprising:

a support body; and a grinding layer, wherein:

the support body has an outer circumferential surface and a central coupling region for attaching the grinding wheel to a rotary drive for rotating the grinding wheel about a rotational axis running through the central coupling region;

the support body includes a first part and a second part connected together via an axial screw connection such that the first part and the second part are in direct contact with each other via a contact surface;

an inner diameter of the grinding layer is greater than an outer diameter of the support body and the grinding layer extends around the outer circumferential surface of the support body on only the first part;

the first part consists of a vibration-conducting material;

the second part exclusively has the central coupling region; and the second part consists of a vibration-damping material selected from the group consisting of cast iron, aluminum bronze, and combinations thereof.

21. A grinding wheel, comprising:

a support body; and a grinding layer, wherein:

the support body has an outer circumferential surface and a central coupling region for attaching the grinding wheel to a rotary drive for rotating the grinding wheel about a rotational axis running through the central coupling region;

the support body includes a first part and a second part connected together via a screw connection;

the first part and the second part are in direct contact with each other;

an inner diameter of the grinding layer is greater than an outer diameter of the support body and the grinding layer extends around the outer circumferential surface of the support body on only the first part;

the first part consists of a vibration-conducting material, and the first part is at least partially arranged between the grinding layer and the second part in a radial direction of the grinding wheel;

the second part exclusively has the central coupling region; and the second part consists of a vibration-damping material selected from the group consisting of cast iron, aluminum bronze, and combinations thereof.

* * * * *